United States Patent [19]

Hoffman et al.

[11] Patent Number: 4,611,798

[45] Date of Patent: Sep. 16, 1986

[54] CLOTH SPREADING APPARATUS

[75] Inventors: Michael E. Hoffman, Lockport; Roy Stevenson, East Aurora, both of N.Y.

[73] Assignee: Cutting Room Appliances Corp., Buffalo, N.Y.

[21] Appl. No.: 804,353

[22] Filed: Dec. 3, 1985

[51] Int. Cl.[4] ..... B65H 29/46

[52] U.S. Cl. ..... 270/31; 242/86.5 R

[58] Field of Search ..... 270/30, 31; 242/86.5

[56] References Cited

U.S. PATENT DOCUMENTS

| | | | |
|---|---|---|---|
| 957,525 | 5/1910 | Weiss | 270/31 |
| 1,131,647 | 3/1915 | Shapera | 270/31 |
| 1,343,339 | 6/1920 | Rosenblum | 270/31 |
| 3,674,253 | 7/1972 | Stumpf | 270/31 |
| 4,193,589 | 3/1980 | Frederick | 270/31 |
| 4,466,602 | 8/1984 | Costigan | 270/31 |

*Primary Examiner*—E. H. Eickholt

*Attorney, Agent, or Firm*—Christel, Bean & Linihan

[57] ABSTRACT

A cloth spreading apparatus for spreading superimposed layers of cloth on a plurality of tables which are connected together side-by-side, the superimposed layers of cloth being in correct alignment with each other. The apparatus includes a cloth laying machine supported on the working surface of the tables for side-to-side traversing movement. As the machine moves from side to side, it will deposit a plurality of superimposed layers of cloth on the tables. The cloth laying machine includes a frame having a front portion normally disposed adjacent a front edge of the tables. The apparatus further includes guide means for guiding the cloth laying machine. The guide means includes a plurality of cylindrical rods, dowels which align the guide rods in end-to-end relationship, and a rail assembly which is rigidly interconnected with the guide rods and with front legs of the tables. The guide means additionally includes a pair of spaced apart horizontally disposed linear bearings mounted on the guide rods and support means interconnecting the bearings with the front portion of the frame of the cloth laying machine.

8 Claims, 7 Drawing Figures

Fig. 1.
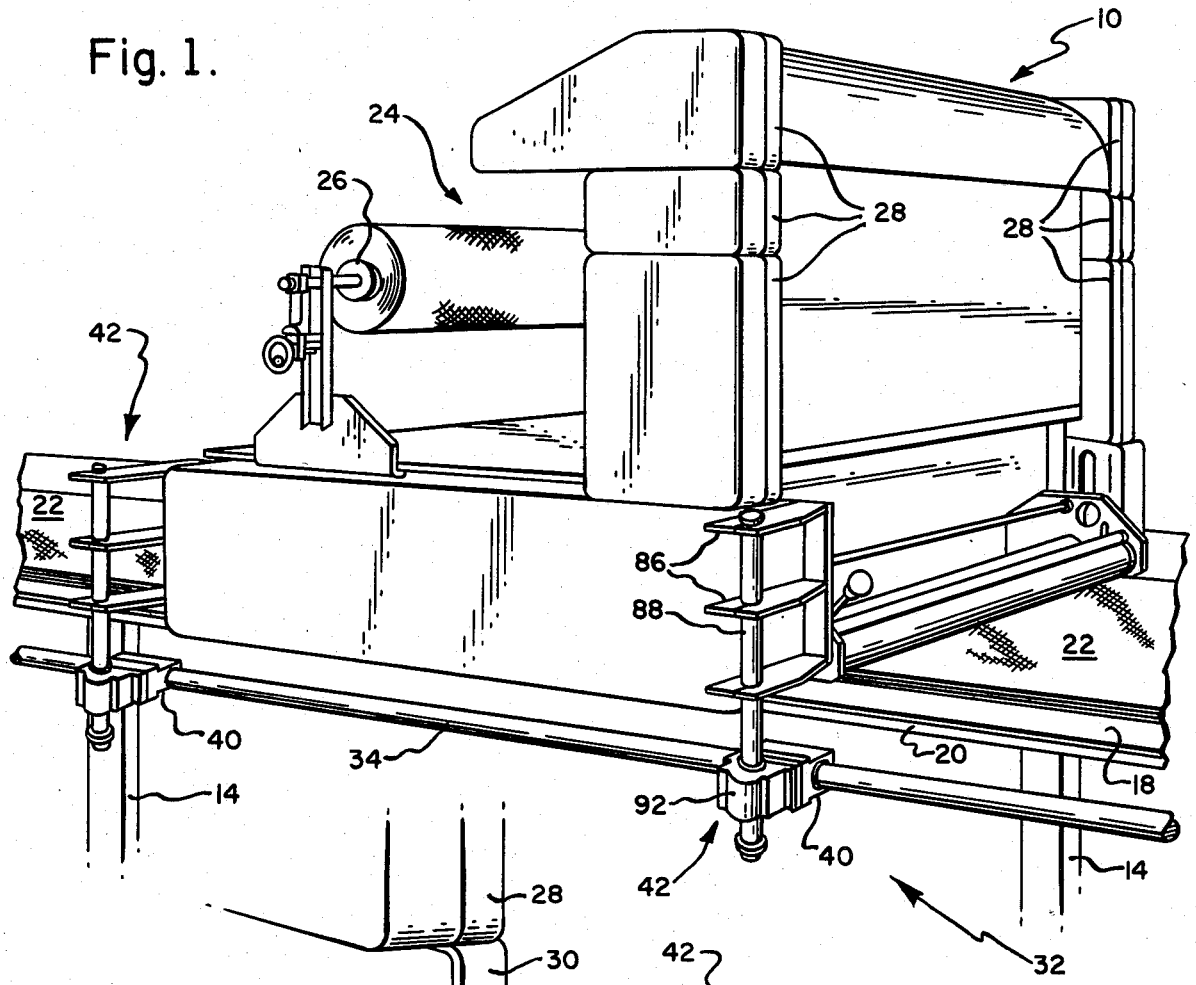
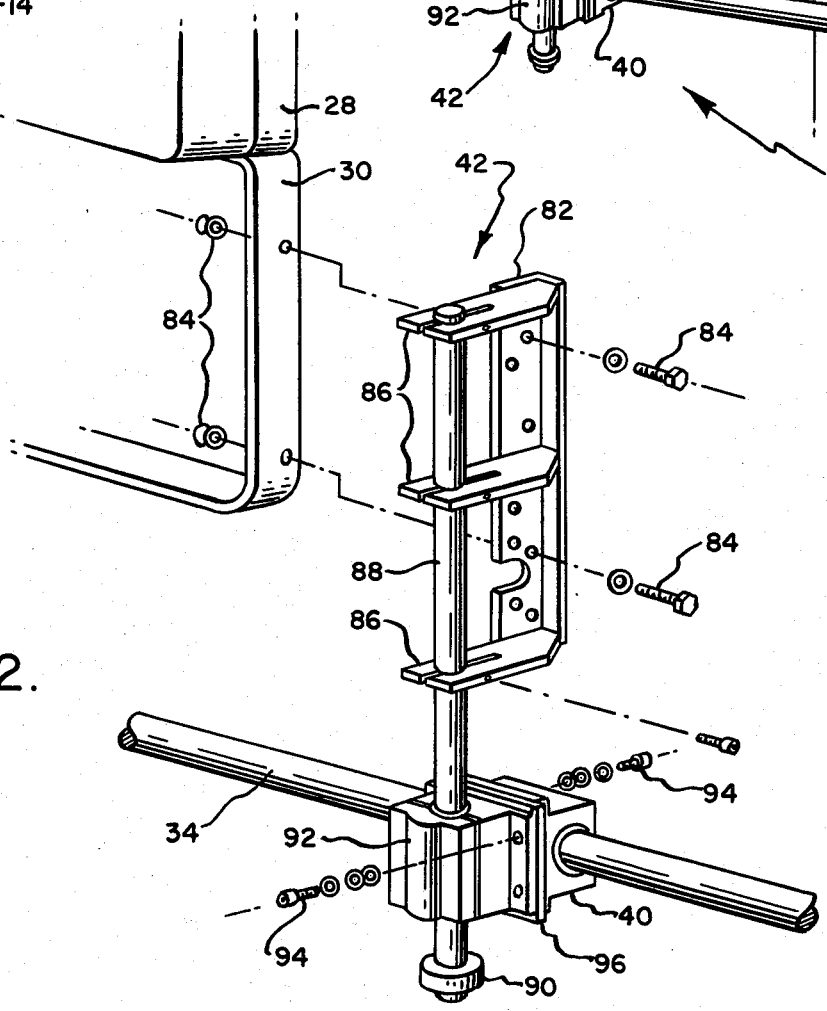
Fig. 2.

Fig. 3.
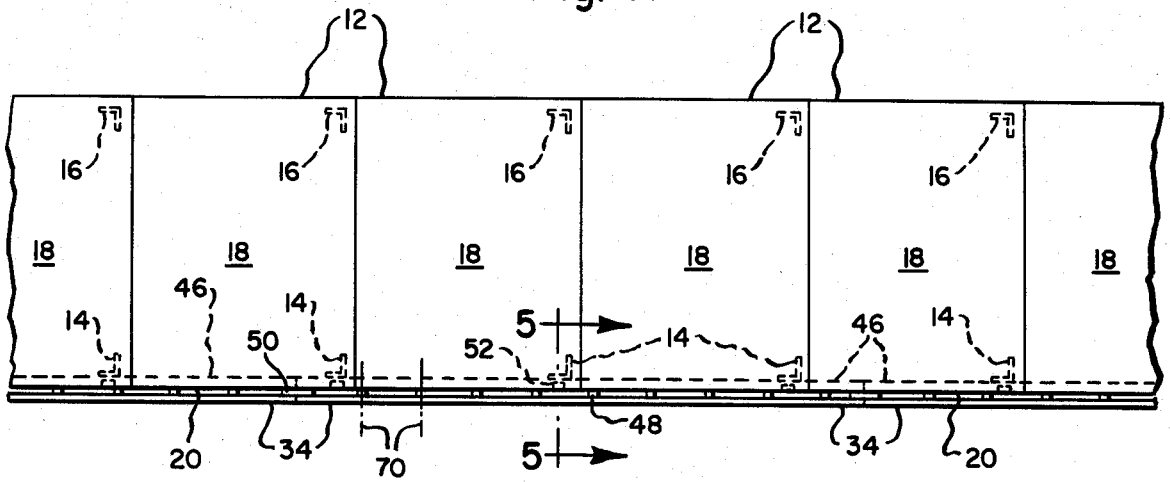
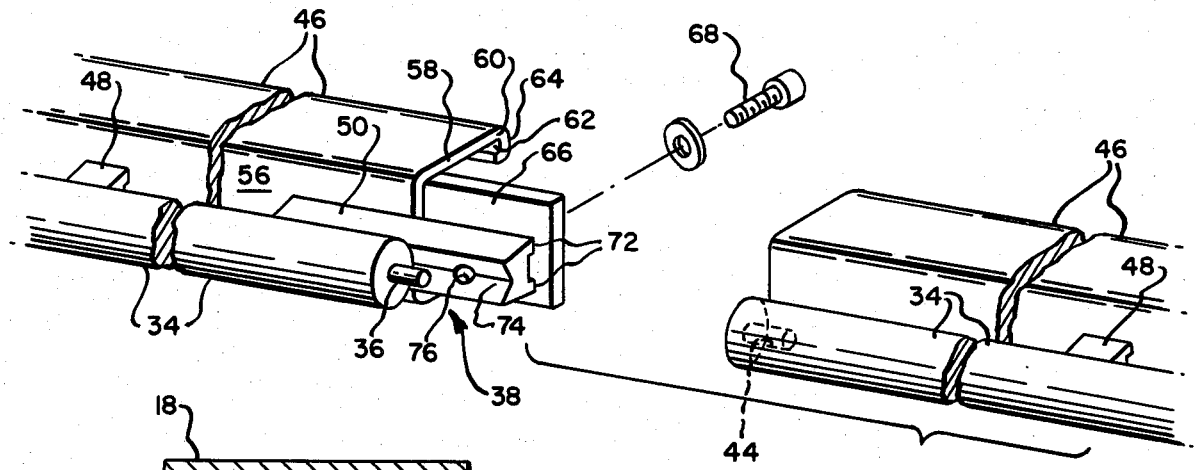
Fig. 4.
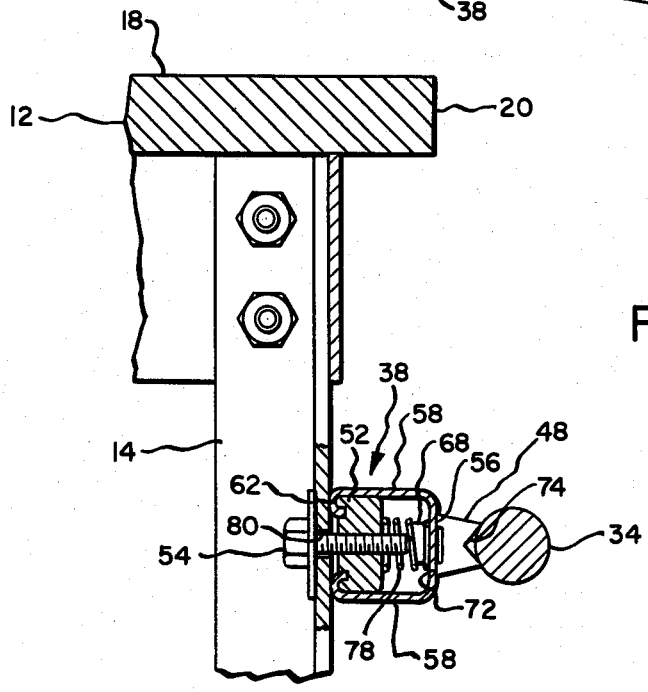
Fig. 5.

Fig. 6.
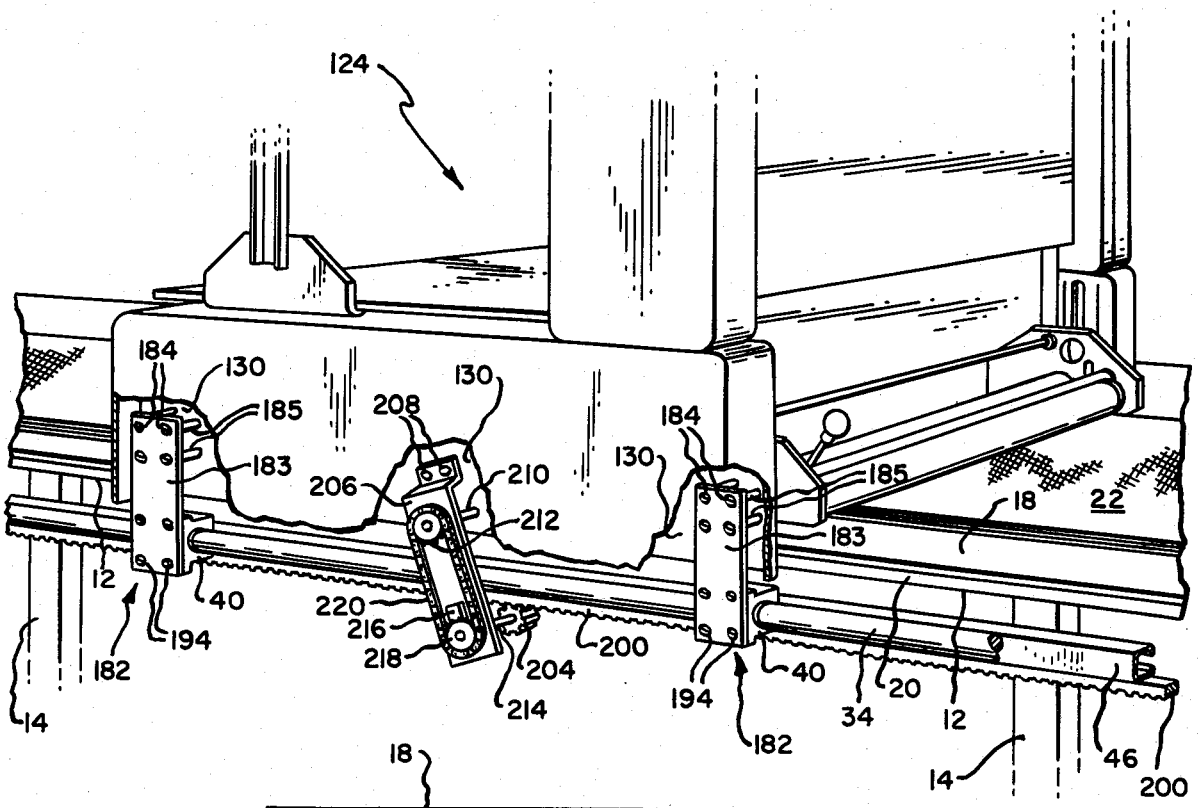
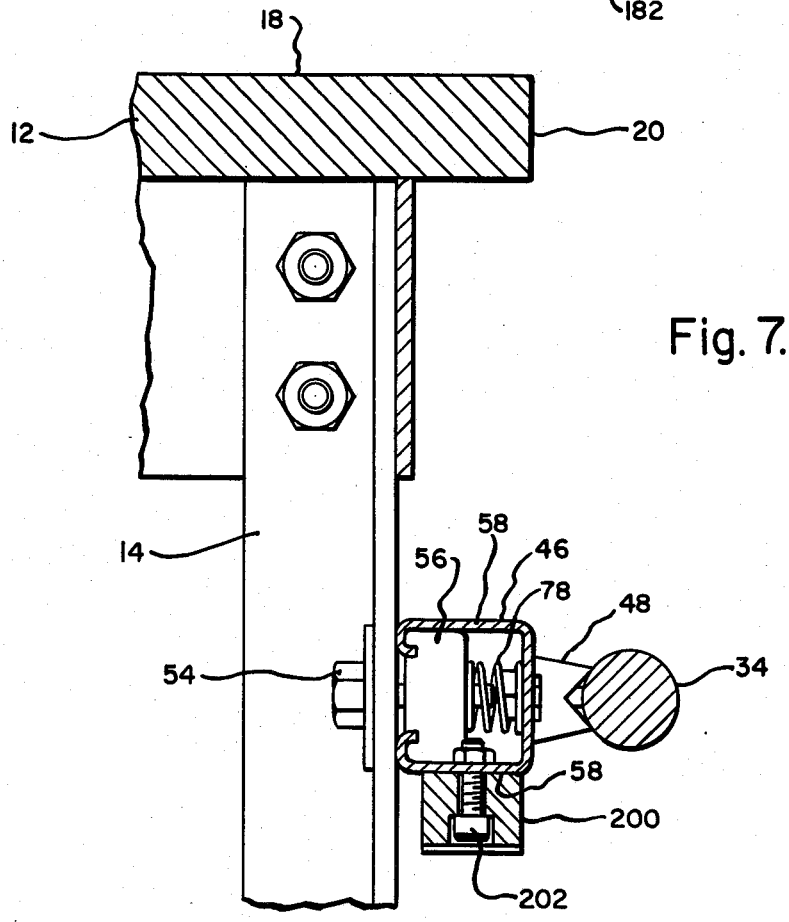
Fig. 7.

CLOTH SPREADING APPARATUS

FIELD OF THE INVENTION

The present invention relates generally to a cloth spreading apparatus, and more particularly to a cloth spreading apparatus including an improved guide associated with a cloth laying machine.

BACKGROUND OF THE INVENTION

A prior art cloth laying machine is illustrated in U.S. Pat. No. 4,177,980 issued Dec. 11, 1979. This machine is mounted on a plurality of cutting tables which are joined to each other in side-by-side relationship. The cutting tables may be of varying depths and therefore it is customary to guide the cloth laying machine from the front edge of the tables only. To this end, the tables are provided with a standard T-shaped guide track along the front edge which is engaged by a grooved wheel carried by the cloth laying machine. In operation, the cloth laying machine will move across the tables and then back again and so on spreading one layer of cloth on top of another until the desired number of layers of cloth have been spread on the cutting tables. This form of machine and its associated guide means have performed in a generally satisfactory manner in the past particularly when spreading flat cloth where the edges of the cloth are to be trimmed. However, the cloth laying machine when guided by a groove wheel has been known to leave the T-shaped guide track and, as the machine is powered by an overhead trolly, it has continued to lay cloth without proper guidance. Where the machine is operating without proper supervision, it is apparent that the machine could continue to operate until it leaves the tables. This obviously is not desirable.

In addition, when spreading tubular knit materials where the edges of the material actually become part of the garment, it is essential that the superimposed layers be in correct alignment with each other at all times. When utilizing the prior T-shaped guide tracks it has frequently been difficult to obtain and maintain proper end-to-end alignment of the various sections of the T-shaped guide tracks. This will cause bending of the adjacent ends of the guide tracks, which will make it difficult to maintain the proper alignment of the superimposed layers with each other. In addition, since the T-shaped guide track is of generally lightweight material, it has been found that as the machine brakes, frequently a twisting motion is applied to the track which also may cause the tracks to become bent preventing the maintenance of the proper alignment of the superimposed layers with respect to each other.

OBJECT AND SUMMARY OF THE INVENTION

It is an object of the present invention to provide guide means formed of a plurality of guide track sections in combination with a cloth spreading machine wherein accurate alignment of adjacent ends of guide track sections can be initially obtained, and which alignment can be easily maintained.

It is a further object of the present invention to provide a guide track mounted on the front edge of a plurality of cutting tables which are joined in side-by-side relationship wherein the guide track is not subject to bending during the braking of the spreading apparatus.

It is a further object of the present invention to provide a guide which can be easily and rigidly installed to a plurality of side-by-side cutting tables.

It is a further object of the present invention to provide guide means of the character set forth above which will insure guidance of the machine under all circumstances.

The above objects are accomplished by providing a plurality of cylindrical guide rod sections and aligning means which align the guide rods in an end-to-end relationship. The guide rods are in turn secured to the front downwardly extending legs of a plurality of adjacent cutting tables by securing means which rigidly secure the guide rods horizontally to the front legs and maintain the rods in a generally parallel relationship to the front edge of the tables. A pair of spaced apart horizontally disposed linear bearings are mounted on the guide rods. Support means mounted on spaced apart front corners of the spreading machine and are in turn interconnected with the horizontally disposed linear bearings. In one embodiment each of the support means may further include a vertically extending shaft and a vertically disposed linear bearing which is mounted on the shaft and which is connected to the associated horizontally disposed linear bearing. In a second embodiment the support means include rigid bracket assemblies secured to the horizontally disposed linear bearings, the support means in this embodiment partially supporting the cloth laying machine on the cylindrical guide rods.

The structure set forth above and the above objects and other objects and advantages of this invention will become more apparent after a consideration of the following detailed description taken in conjunction with the accompanying drawings in which a preferred form of this invention is illustrated.

BRIEF DESCRIPTION OF THE DRAWINGS

FIG. 1 is a perspective view of a first embodiment wherein a cloth laying machine disposed upon the surface of a plurality of adjacent side-by-side cutting tables, and guide means are provided for guiding the cloth laying machine for traversing movement across the surface of the tables.

FIG. 2 is an exploded perspective view of a portion of the guide means shown in FIG. 1 and also a portion of a cloth laying machine.

FIG. 3 is a top plan view of a plurality of cutting tables which are joined together in side-by-side relationship, the cutting tables being provided with a plurality of cylindrical guide rods which are aligned in end-to-end relationship and securing means which rigidly secure the guide rods to the front legs of the tables.

FIG. 4 is an enlarged exploded perspective view showing the manner in which the guide rods are aligned with respect to each other, and relatively rigid rails to which the guide rods are rigidly secured.

FIG. 5 is a view taken generally along the line 5—5 in FIG. 3 showing the securing means by which the rails are secured to the downwardly extending table legs.

FIG. 6 is a perspective view similar to FIG. 1 showing a second embodiment of this invention.

FIG. 7 is a view similar to FIG. 5 showing a rack mounted on the securing means.

DETAILED DESCRIPTION

Referring initially to applicants' first embodiment, and more particularly to FIGS. 1 and 3, the cloth spreading apparatus of this invention, which is indicated generally at 10 in FIG. 1, is supported by a plurality of side by-side cutting tables 12. Conventionally, the tables are 48 inches wide and are varying depths, such as for example 54 or 60 inches. In any event, the tables are joined in a side-by-side relationship and are supported by front and rear downwardly extending legs 14, 16, respectively. As shown in FIG. 3, each table is only provided with two right-hand legs, the left-hand side of the table being supported by the adjacent table. However, the table all the way to the left would of course be supported by four legs. In addition, it should be appreciated that each of the tables may be provided with four legs. Each table has a horizontal upper working surface 18 and a front edge 20. As can be seen again in FIG. 3, the front legs are spaced inwardly of the front edge, the spacing being relatively uniform throughout the varying tables.

Supported on the top horizontal surface 18 of the tables 12 is a cloth laying machine which may be of the type shown in U.S. Pat. No. 4,177,980, the subject matter of which is incorporated herein by reference thereto. As can be seen from FIG. 1, the layers of cloth, indicated at 22, laid upon the cutting tables, do not extend from the front edge of the tables to the back edge but are in fact spaced inwardly thereof. This is because the driving wheels for the cloth laying machine of the first embodiment, indicated generally at 24, run upon the surface of the table adjacent the front edge and adjacent the rear edge of the cloth. As the cloth laying machine is more fully disclosed in the aforementioned patent, it will not again be disclosed here other than to note that it may support a roll of cloth on roller 26, the roll of cloth weighing up to 1000 pounds or more. In addition, the cloth laying machine has a frame 28, a front portion 30 being disposed adjacent the front edge of said tables.

In accordance with this invention guide means, indicated generally at 32, are provided in combination with the cloth laying machine for guiding the machine upon the surface of the tables in such a manner as to cause the superimposed layers of cloth 22 to be in correct alignment with each other.

The guide means includes a number of major components, these being a plurality of guide track sections in the form of cylindrical guide rods 34, aligning means 36 to align the rods end-to-end, and securing means indicated generally at 38 (FIG. 5) for rigidly securing the guide rods to the front and downwardly extending legs of the tables in such a manner that the rods 34 are generally parallel to the front edge 20 of the tables. In addition, the guide means also includes a pair of spaced apart horizontally disposed linear bearings 40 and support means, indicated generally at 42, which interconnect the spaced apart bearings 40 with the front portion 30 of the frame 28 of the cloth laying machine 24.

The guide rods are best illustrated in FIGS. 3 and 4 and as can be seen from FIG. 3, there are a number of separate guide rods. In the preferred embodiment which is illustrated in FIG. 3, the width of each of the tables is 4 feet, and the length of each individual guide rod is approximately 10 feet. If the table has an effective length of 50 feet, five individual guide rods 34 will be provided. It is essential that these guide rods be mounted in correct alignment with each other and to this end, the aligning means 36 are provided which are in the form of dowels. Each adjacent end of a guide rod 34 is provided with a concentric dowel receiving bore, each bore having a length just slightly in excess of one half of the length of a dowel, the bores being so sized with respect to the dowels that a dowel can be snugly received within each bore. Each dowel will be initially driven into one of the bores, for example the bore at the right-hand end of each of the guide rods, and when the rods are being assembled onto the tables, each successive rod will be positioned with its left-hand bore receiving the right-hand end of the associated dowel, the parts being finally driven together to insure that the rods are in a correct aligned end-to-end relationship with each other. The manner of assembly will be more fully brought out below.

The securing means 38 includes a number of individual components and specifically sections of relatively rigid rail 46, a plurality of short and long apertured blocks 48, 50, respectively, and a rail fastening means which include a nut 52 and bolt 54. The rail is of a type sold under the trade name UNISTRUT by GTE Products Corporation or an equivalent, and is generally C-shaped in cross-section. More specifically, the rail includes a planar portion 56 which is assembled parallel to the plane defined by the downwardly extending table legs 14, a pair of upper and lower generally parallel legs 58 and inturned ends 60 at the ends of the legs remote from the planar portion, the inturned ends being provided with inner and outer surfaces 62, 64, respectively. In order to insure that the lengths of the rails, which are also approximately 10 feet long in the preferred embodiment, are properly aligned with respect to each other plates 66 are provided which are disposed adjacent the end portions of the planar portions 56. The rails are provided with a number of spaced apart apertures (not shown), the apertures being spaced apart from each other approximately 12 inches, the apertures in turn receiving fasteners 68. The fasteners in turn also pass through the apertured blocks 48 and 50 and are received within a plurality of radially extending threaded apertures formed in the guide rods 34, these apertures being represented by the construction lines 70 in FIG. 3. Each of the apertured blocks 48, 50 is provided with a planar surface 72 which is mounted to be in contact with the planar portion 56 of the rail 46 and an opposed surface having a V-shaped groove formed therein. Each of the apertures within the blocks 48, 50 extends through the bottom of the V-shaped groove. As can be seen from FIG. 4, the long apertured blocks 50 bridge the ends of adjacent rails 46 and are provided with two apertures. The short apertured blocks 48 are only provided with one aperture.

As previously noted, the rails 46 are secured to the front table legs by nuts and bolts 52, 54. The nuts are initially placed within the rails and are so sized that they cannot turn relative to the rails, the nuts prior to final assembly being forced against the inner surface 62 of the inturned ends 60 by springs 78 which serve to maintain the nuts in their desired pre-assembled position. Each front table leg is provided with a suitable aperture 80, the apertures 80 being spaced equal distances from the top of the table, for example 6 inches. The bolt 54 will pass through the table leg apertures 80 and then be screwed into the nuts 52.

The procedure for installing the guide rods 34 and rails 46 to the table legs will now be discussed. Initially, the rods 34 are assembled onto the rails 46 by positioning the blocks 48 and 50 onto the planar portion 56 of each rail with the blocks 48 and 50 being in aligned position with the apertures in the associated rail and assembled generally in the manner indicated in the left-hand portion of FIG. 4. A guide rod 34 is then placed onto the V-shaped groove 74 of the blocks 48, 50 with the apertures in the guide rod in alignment with the apertures in the blocks. The guide rod is now rigidly secured to the rail 46 by the fasteners 68, the fasteners 68 also securing the plates 66 to the right hand end of adjacent rails. The guide rod and rail subassemblies can be completed prior to shipping.

When it is desired to assemble the guide rod and rail subassemblies to the tables, it is then necessary to drill holes or apertures in the table legs all approximately the same length from the table top and centered side-to-side. The rail/guide rod subassemblies are now assembled by being loosely bolted onto the table starting at the left-hand end and working to the right. As each additional section is added to the tables, the right-hand end of the section is tapped with a hammer to remove the clearance between the rods. After the clearance has been removed, the joints are screwed together by fastener 68 which passes through the right-hand aperture 76 in a long apertured block 50 until the rods are very closely aligned. After all of the guide rods and rails have been assembled loosely to the table legs and after all joints have been removed of clearance and screwed together, it is then only necessary to tighten the nut and bolt assemblies 52, 54 to firmly fasten the rail/rod subassemblies to the tables.

After the rails 46 and guide rods 34 have been assembled to the tables 12, it is then only necessary to slip two linear bearings over the ends of the rods and to properly position them so that they can then be assembled to the cloth laying machine supported on the table. The linear bearings which are used are preferably a type SPB-OPN manufactured by Thomson Industries, Inc.

After the bearings 40 have been assembled onto the guide rods 34, it is now only necessary to interconnected them with the cloth laying machine by means of the support means 42. The support means includes support assemblies, one support assembly being secured to the front right-hand portion of the frame of the cloth laying machine and another support assembly being secured to the front left-hand portion. Each support assembly includes a bracket assembly 82 which is secured to a front portion 30 of the frame by fasteners 84. The bracket assembly includes vertically spaced apart horizontally disposed slotted and bored members 86 to which a vertically extending shaft 88 may be rigidly secured. The lower end of the shaft 88 carries a stop 90. Disposed between the lowermost member 86 and the stop 90 is a vertically disposed linear bearing 92. The vertically disposed linear bearing 92, which may be a type SPB pillow block, also manufactured by Thomson Industries, Inc., is affixed to the horizontally disposed linear bearing 40 by means of fasteners 94 and linear bearing plate 96.

It can be seen that when the support means 42 are fully secured both to the front portion 30 of the frame of the cloth laying machine and to the horizontally disposed linear bearings 40, the machine will be guided for traversing side-to-side movement upon the surface of the tables 12. If there are any irregularities on the surface of the table, the machine can shift vertically due to the bearings 92 which are disposed about the shafts 88. However, the machine is accurately guided for side-to-side movement by the bearings 40 on guide rods 34 and the structure is such that the machine will lay down correctly aligned superimposed layers of cloth one upon the other as it moves back and forth across the table. In addition, because the bearing 40 at least partially encloses the guide rod 34 and since all of the other parts are interconnected to each other, it is not possible for the cloth laying machine to become disengaged from the guide means.

Referring now to applicants' second embodiment, and more particularly to FIGS. 6 and 7, the same reference numerals will be applied to indicate like parts. Thus, the apparatus of this embodiment is supported upon tables 12 having front legs 14. Each table has a horizontal upper surface 18 and a front edge 20. Cylindrical guide rails 34 are supported on the legs 14 by rails 46 there being blocks 48 (and 50, not shown) disposed between the guide rods 34 and the rails 46. In addition, the rails are secured to the legs 14 by bolts 54 and nuts 56. A pair of horizontally disposed linear bearings 40 are disposed about the guide rods 34. The design shown in this second embodiment differs in two significant aspects. Thus, the front portion of the cloth laying machine, indicated generally at 124, is supported upon the cylindrical guide rails 34. In addition, the drive wheels which normally run upon the upper surface 18 of the tables 12 adjacent the front edge 20 are replaced by a rack and pinion drive.

In this design, right and left-hand substantially identically bracket assemblies, indicated generally at 182 are secured to the front portion of the frame 130 of the machine 124. The bracket assemblies include a vertically extending frame member 183 which is secured to the frame 130 by fasteners 184 and cylindrical spacers 185. The lower end of the frame member 183 is in turn secured to an associated horizontally disposed linear bearing 40 by fasteners 194 which pass through suitable apertures in the frame member. These apertures may be slotted to permit vertical adjustment. By employing the construction just described, the front portion of the cloth laying machine 124 may be supported upon the guide rods 34.

The drive means of this embodiment includes a rack 200 secured to the lower surface of the rail 46 by screws 202, the head of the screws being received within suitable recesses within the rack 200. A pinion 204 engages the rack, the pinion in turn being mounted upon a suitable bracket 206 which is secured to the front portion of the frame 130 by fasteners 208. Passing through a suitable aperture in the bracket 206 is a drive shaft 210 which carried a drive sprocket 212. The pinion gear 204 is in turn mounted upon a pinion shaft 2214 which passes through a suitable slot in the bracket 206 and which is supported by a bearing block 216 adjustably secured to the bracket 206 by suitable nuts and bolts. The forward end of the pinion shaft 214 receives a driven sprocket 218, the drive sprocket 212 in turn driving the driven sprocket 218 through a chain 220. The rack 200 is mounted on the lower surface of the rail 46 so that it will be self cleaning. The bracket 206 may be adjustably secured to the frame in such a manner that right and left hand adjustment of the pinion gear 204 is possible. In addition, the bearing block 216 may also be adjustably secured to the bracket 206 to permit vertical adjustment of the pinion gear. However, once the parts are in their desired position, they will be rigidly secured so that in normal operation the pinion gear 204 will firmly engage the rack 200 to permit the machine to be driven.

In a third embodiment of this invention the bracket assemblies 182 will be utilized to cause the front portion of the cloth laying machine to be supported upon the guide rods 34, however, in this embodiment drive wheels will engage the surface 18 of the tables 12. The drive wheels may be pneumatic tires which can flex sufficiently to accomodate for spacing differences between the surface 18 and the axis of the guide rods 34. Alternatively, the drive wheels may be spring loaded in such a manner that they are maintained in constant contact with the surface of the table even though the distance between the surface 18 and the axis of the guide rods 34 may vary.

While a preferred structure in which the principles of the present invention have been incorporated is shown and described above, it is to be understood that this invention is not to be limited to the particular details shown and described above, but that, in fact, widely differing means may be employed in the practice of the broader aspects of this invention.

What is claimed is:

1. A cloth spreading apparatus for spreading superimposed layers of cloth on a plurality of tables which are connected together side by side, each table having a horizontal upper working surface and a front downwardly extending leg, the superimposed layers of cloth being subsequently cut; said apparatus comprising:

cloth laying machine at least partially supported on the working surface of a plurality of side-by-side tables for side-to-side traversing movement across the working surface of said tables, said cloth laying machine being capable of depositing a plurality of superimposed layers of cloth on the working surface of the tables as said cloth laying machine traverses the tables, said cloth laying machine including a frame having a front portion disposed adjacent a front edge of said tables; and guide means for guiding said cloth laying machine as it traverses the tables to cause the superimposed layers of cloth to be in correct alignment with each other, said guide means including a plurality of cylindrical guide rods, aligning means aligning said guide rods in end-to-end relationship, securing means rigidly securing said guide rods horizontally to the front legs of said tables and generally parallel to the front edge of said tables, a pair of spaced apart horizontally disposed linear bearings mounted on said guide rods, and support means interconnecting said spaced apart horizontally disposed linear bearings with the front portion of the frame of said cloth laying machine.

2. A cloth spreading apparatus as set forth in claim 1 wherein the aligning means are dowels, the cylindrical guide rods being provided with concentric dowel receiving bores at adjacent ends.

3. A cloth spreading apparatus as set forth in claim 1 wherein each of the guide rods is provided with a plurality of radially extending parallel threaded apertures, and wherein the securing means includes a relatively rigid rail having a planar portion disposed parallel to the front downwardly extending legs of said tables, said planar portion being provided with a plurality of apertures, a plurality of blocks each having a V-shaped groove and a planar surface in contact with the planar portion of the rail, each of said blocks further being provided with an aperture extending through the block to the bottom of the V-shaped groove, a plurality of threaded fasteners each of which passes through an associated aperture in the rail and an associated apertured block and which is received within an associated radially extending threaded aperture in an associated guide rod to rigidly secure the guide rod to the rail, and rail fastening means rigidly securing the rail to said front downwardly extending table legs.

4. A cloth spreading apparatus as set forth in claim 3 wherein each rail is a C-shaped relatively rigid structural member having generally parallel legs provided with inturned ends having inner and outer surfaces, and wherein the rail fastening means is a nut disposed within the C-shaped structural member and bearing against the inner surface of the inturned ends, and a threaded fastener passing through an aperture in an associated front downwardly extending table leg and received within the nut, the threaded fastener causing the outer surface of the inturned ends to bear against the front surface of the associated table leg.

5. The cloth spreading apparatus as set forth in claim 1 wherein said support means includes a pair of support assemblies secured to opposite sides of the front portion of said frame, each support assembly having a bracket assembly secured to a side of the front portion of said frame, a vertically extending shaft secured to said bracket assembly, and a vertically disposed linear bearing mounted on said shaft and connected to an associated one of said pair of horizontally disposed linear bearings.

6. The cloth spreading apparatus as set forth in claim 1 wherein the support means includes a pair of rigid bracket assemblies secured to opposite sides of the front portion of the frame, each bracket assembly being connected to an associated one of said pair of horizontally disposed linear bearings, the cloth laying machine being partially supported on said cylindrical guide rods.

7. The cloth spreading apparatus as set forth in claim 1 wherein a rack is mounted on the securing means, and further characterized by the provision of drive means carried by the cloth laying machine and engaging said rack.

8. The cloth spreading apparatus as set forth in claim 6 wherein a rack is mounted on the securing means, and further characterized by the provision of drive means carried by the cloth laying machine and engaging said rack.

* * * * *